United States Patent [19]

Cesna

[11] Patent Number: 4,593,716

[45] Date of Patent: Jun. 10, 1986

[54] CONTROL VALVE ASSEMBLY FOR ABRASIVE SLURRY

[75] Inventor: Joseph V. Cesna, Niles, Ill.

[73] Assignee: Speedfam Corporation, Des Plaines, Ill.

[21] Appl. No.: 182,125

[22] Filed: Aug. 28, 1980

[51] Int. Cl.[4] ..... F17D 1/14; F16K 5/04; B24B 57/02

[52] U.S. Cl. ..... 137/561 A; 137/563; 137/625.47; 137/876; 51/317

[58] Field of Search ..... 51/131.2, 131.3, 133, 51/317; 137/563, 561 A, 625.47, 876

[56] References Cited

U.S. PATENT DOCUMENTS

| | | | |
|---|---|---|---|
| 2,839,877 | 6/1958 | Boettcher | 51/131.2 |
| 3,505,766 | 4/1970 | Boettcher | 51/131.2 |
| 3,640,308 | 2/1972 | Bydal | 137/561 A |
| 4,187,882 | 2/1980 | Watson | 137/563 |
| 4,299,553 | 11/1981 | Swaroop | 137/561 A |

*Primary Examiner*—Martin P. Schwadron
*Assistant Examiner*—John A. Rivell
*Attorney, Agent, or Firm*—Charles F. Pigott, Jr.

[57] ABSTRACT

A control valve assembly for controlling the flow of abrasive slurry from a supply pump, directing a selected amount of abrasive slurry to the lapping wheel of an associated lapping machine, and recirculating the remainder of the supply of abrasive slurry to the supply pump.

3 Claims, 6 Drawing Figures

FIG. 2
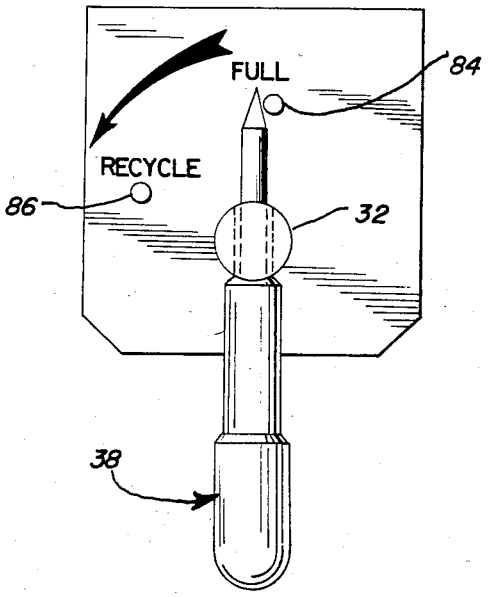
FIG. 3
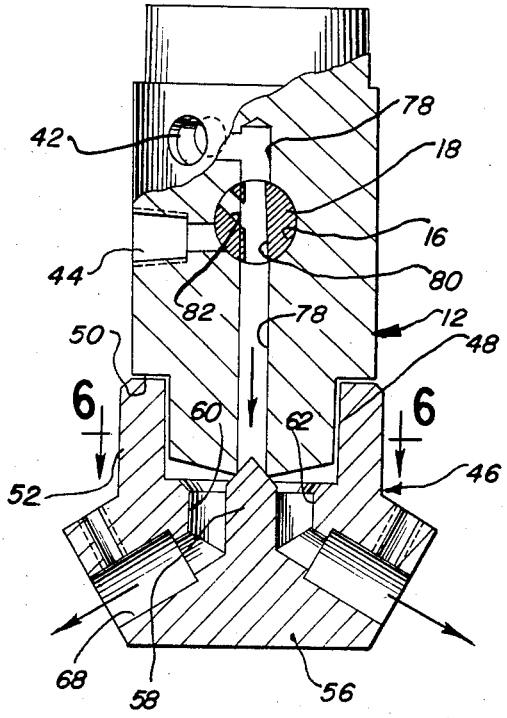
FIG. 4
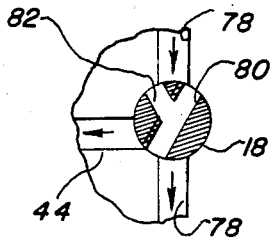
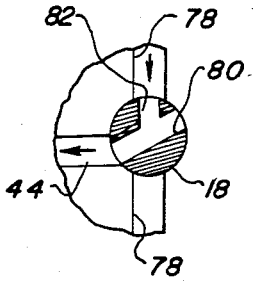
FIG. 5
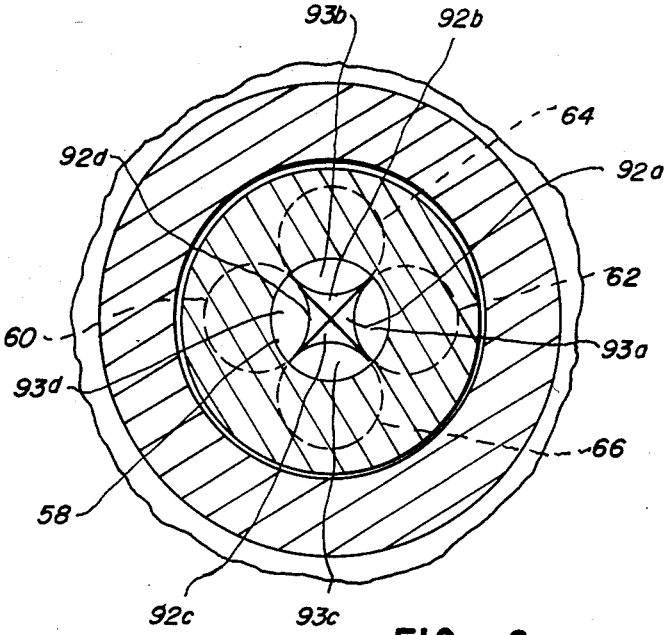
FIG. 6

CONTROL VALVE ASSEMBLY FOR ABRASIVE SLURRY

BRIEF SUMMARY OF THE INVENTION

The present invention relates to a control valve for controlling the flow of abrasive slurry to the lapping wheel of a lapping machine or the like with which the control valve is associated. It is well known to supply a freely flowing abrasive slurry to the lapping wheel of a lapping machine or similar machine during a lapping operation. Such abrasive slurry is comprised of abrasive particles and a carrier vehicle, and is normally circulated by means of a pump.

A lapping machine of the type with which the control valve of the present invention may be used is disclosed in U.S. Pat. No. 3,110,988. In addition, a known form of control valve for use in supplying abrasive slurry to such a lapping machine is shown in U.S. Pat. No. 3,329,167.

It is known to connect a lapping machine to a supply of abrasive slurry and to provide a supply pump for pumping the abrasive slurry. A preferred arrangement is to provide a supply tank and associated pump, a supply line from the pump through a control valve to the lapping machine, and a return line from the control valve back to the pump. One or more control valves are provided which control the amount of abrasive slurry conducted from a supply line to the lapping wheel of the lapping machine, and the amount which is recirculated from the inlet line through the valve and back to the pump. It will be understood that if more abrasive slurry is desired at the lapping wheel, the control valve is set so that less slurry is recirculated to the pump and more is conducted to the wheel. On the other hand, if an operator wishes to reduce the amount of slurry conducted to the lapping wheel, he will set the valve to increase the amount of slurry being recirculated to the pump.

A supply tank or container for the abrasive slurry is provided in association with the pump. The abrasive slurry which is conducted to the lapping wheel for use in a lapping operation is normally not reused, and thus it is necessary periodically to add additional abrasive and vehicle to the storage container.

It is highly desirable to operate the pump to provide continuous circulation of the abrasive slurry, even if only a small portion of the slurry is needed at the lapping wheel. Thus, the amount of abrasive slurry desired at the lapping wheel is determined by setting the control valve, and the remainder of the supply of abrasive slurry is recirculated to the pump. The objective is to keep the slurry circulating, because if it is allowed to become stagnant, the abrasive particles will settle out thereby tending to cause blockages and variation in cutting speed.

Abrasive slurry is difficult to pump through pipes and valves without blockage problems developing, and known types of valves used to control the flow of such slurry have not been successful in eliminating such problems. Thus, an objective of this invention is to provide an improved control valve for an abrasive slurry pumping system which valve reduces the tendency of the slurry to cause blockages.

Another object of the invention is to provide an improved directional control valve member which is adjustable to control the amount of abrasive slurry directed to the lapping wheel and the amount which is recirculated to the pump.

A further object is to provide a directional control valve as last above-mentioned which is positioned so that abrasive slurry being conducted to the lapping wheel is passed vertically downward through the control valve to a splitter member which conducts the slurry to a plurality of different tube members leading to different areas on the lapping wheel.

Still another object of the invention is to provide an improved 4-way splitter member which receives abrasive slurry from the directional control valve and directs it to four separate tubular passages for delivery to four different areas on a lapping wheel.

The foregoing and other objects and advantages of the invention will be apparent from the following description of a preferred embodiment, taken in conjunction with the accompanying drawings.

DESCRIPTION OF THE DRAWINGS

FIG. 2 is an end elevational view, looking in the direction of the arrows 2—2 of FIG. 1, showing a handle for effecting manual control of the directional control valve member;

FIG. 3 is a vertical sectional view taken along the line 3—3 of FIG. 1;

FIGS. 4 and 5 are fragmentary views of the rotatable spool element of FIG. 1 showing the element in different rotational positions to direct different amounts of abrasive slurry to a lapping wheel; and FIG. 6 is an enlarged horizontal sectional view, taken approximately along the line 6—6 of FIG. 3, showing four valve openings of equal size through which abrasive slurry passes in being conducted to four tubular members leading to different areas on the lapping wheel of a lapping machine.

Figure 1:
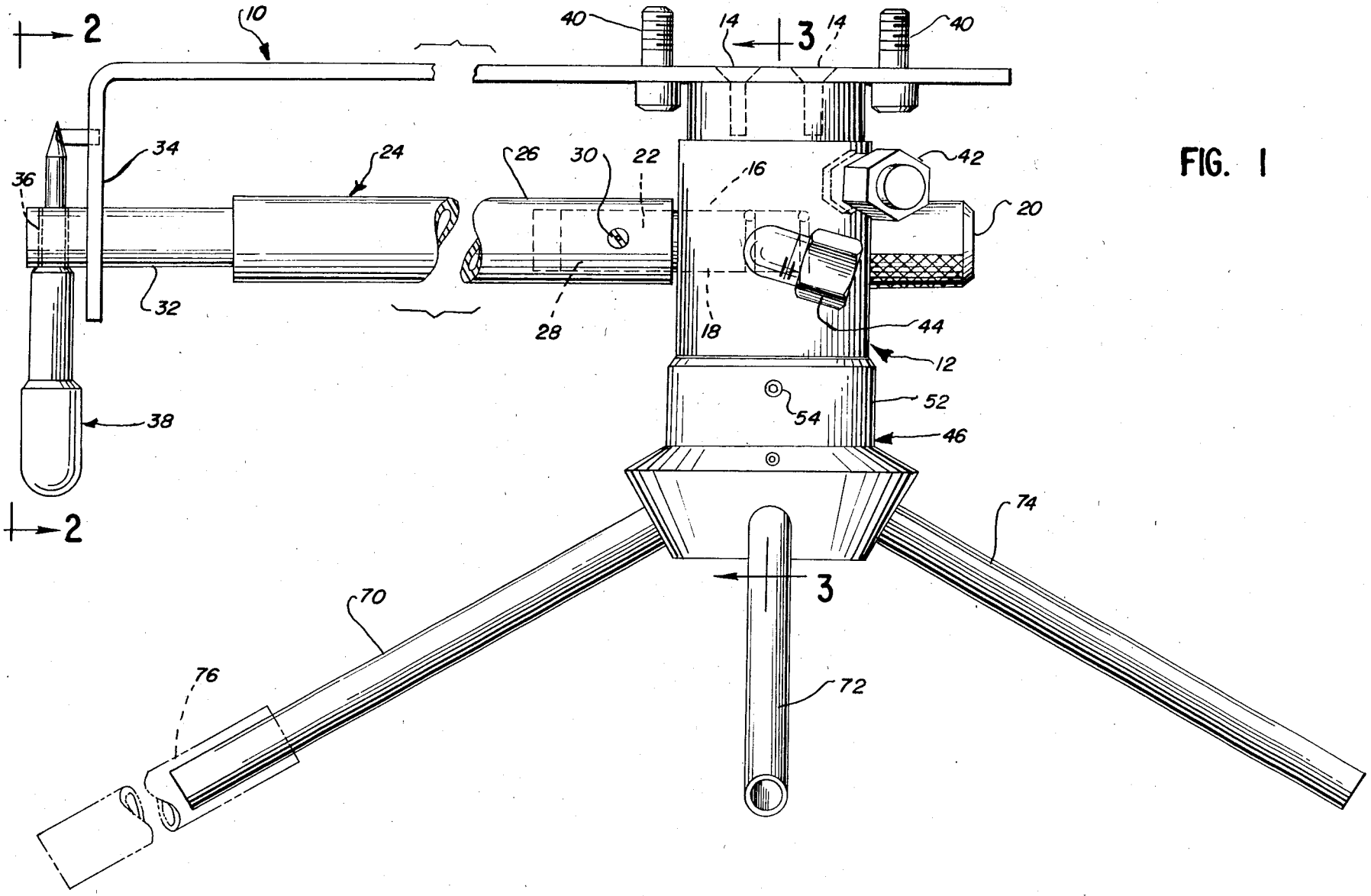
FIG. 1 is an elevational view of an abrasive valve assembly constructed in accordance with the present invention.

Now, in order to acquaint those skilled in the art with the manner of making and using my invention, I shall describe, in conjunction with the accompanying drawings, a preferred embodiment of the invention.

DETAILED DESCRIPTION OF THE INVENTION

Referring now to the drawings, FIG. 1 shows a mounting bracket 10, and a valve body 12 secured to the underside of the bracket by two or more screws 14 which are threaded down through the bracket into the top of the valve body. The valve body 12 has a horizontal bore 16 which extends completely through the valve body and receives therein a rotatable spool element 18. The spool element 18 is inserted into the valve body 12 from the right side thereof as viewed in FIG. 1, and the spool element includes an enlarged knurled end portion 20 which facilitates handling the spool which can be removed for purposes of service.

When the spool element 18 is inserted in bore 16 of valve body 12 to the position shown in FIG. 1, the left end 22 projects beyond the valve body. A rod 24 has a body portion 26 having a bore 28 which receives the projecting end 22 of the spool element. Rod 24 is secured to spool end 22 by a radial screw 30, and the opposite end 32 of the rod is of a reduced diameter and fits through an opening in a downwardly bent end portion 34 of the bracket 10 so as to be rotatably supported in the latter. At the end of rod portion 32 there is a transverse hole 36 in which a handle 38 is mounted for manual rotation of rod 24 and spool element 18 to control the flow of abrasive slurry as will be described hereinafter.

The valve assembly shown in FIG. 1 may be mounted to the frame of a lapping machine by using the vertical screw members 40 which extend upwardly through the bracket 10 adjacent valve body 12. The assembly includes an inlet fitting 42 where abrasive slurry from a supply tank (not shown) is received in valve body 12, a return fitting 44 which connects to a return pipe (not shown) leading back to the supply tank, and a 4-way splitter member 46.

As best shown in FIG. 3, valve body 12 has a reduced diameter lower end portion 48 which projects downwardly from an annular shoulder 50. The 4-way splitter member 46 has an upwardly projecting sleeve 52 which fits over the reduced diameter portion 48 of the valve body 12 and extends adjacent annular shoulder 50. The 4-way splitter 46 is secured in position on the lower end of valve body 12 by one or more radial set screws as shown at 54 in FIG. 1.

The lower body portion 56 of 4-way splitter 46 includes a central upwardly directed divider member 58 which is surrounded by four generally vertical passages 60, 62, 64 and 66 (see FIGS. 3 and 6). As shown in FIG. 3, generally vertical passage 60 leads to an inclined passage 68 which is of a larger diameter to accommodate the thickness of a tubular member as shown at 70 in FIG. 1. Each of the other vertical passages is similarly associated with an inclined passage to which a tubular member is connected as shown at 72 and 74 in FIG. 1, the fourth tubular member (not shown) being oppositely disposed to tubular member 72. FIG. 1 further shows an extension tube 76 of a type which may be connected to each of the tubes projecting from the 4-way splitter 46 in order to reach the desired areas on an associated lapping wheel.

It will be understood that a conventional lapping machine of the type shown in U.S. Pat. No. 3,110,988 includes a large segmented plate or lapping wheel which rotates about a vertical axis, and four ring members which are positioned on top of the lapping wheel. The work pieces to be lapped are positioned within the four ring members, and pressure plate members press down on the work pieces to hold them against the lapping wheel. Abrasive slurry is supplied to the lapping wheel adjacent each of the four ring members within which the work pieces are positioned.

The practice is to supply the abrasive slurry to the segmented plate at four different locations, each location being adjacent one of the four ring members at a spot depending upon the direction of rotation of the ring so that the slurry will be conveyed beneath the ring and under the parts. The foregoing will explain why a 4-way splitter is provided as a part of the valve assembly, and why each of the four passages in the splitter is associated with tubular members as shown at 70 and a tubular extension as shown at 76. It should be noted that the diameter of the inclined passages such as at 68 in FIG. 3 is greater than the diameter of the associated vertical passage 60 by an amount equal to twice the thickness of the tube 70. Thus, the objective is to provide a constant internal diameter passage for the abrasive slurry.

In the operation of the valve assembly of the present invention, abrasive slurry is pumped from a supply container (not shown) to the inlet shown at 42 in FIGS. 1 and 3. The abrasive slurry flows from inlet 42 to a vertical passage 78 (see FIG. 3) which communicates with the horizontal bore 16 in which rotatable spool 18 is positioned. The vertical passage 78 also extends from the lower side of bore 16 through to the bottom of the reduced diameter portion 48 of valve body 12 where it communicates with the passages 60, 62, 64 and 66 in the 4-way splitter 46. Spool 18 includes a first passage 80 which extends straight through the spool and is shown vertically positioned in FIG. 3, and a second passage 82 which is inclined relative to passage 80 and communicates with the latter adjacent its mid-portion.

FIG. 2 shows the handle 38 for positioning the rotatable spool 18. A pair of stop pins 84 and 86 is mounted on bracket end portion 34 and cooperates with a pointed end portion 88 of handle 38 to limit movement of handle 38 and rotatable spool 18. When the pointer 88 is in the vertical position against stop 84 as shown in FIG. 2, spool 18 is in the position shown in FIG. 3 with passage 82 inoperative and with passage 80 fully aligned with vertical passage 78 in valve body 12. In the latter position of spool 18, all of the abrasive slurry received at inlet 42 is conducted vertically downward to the 4-way splitter 46 with the result that a maximum amount of slurry is supplied to the lapping disc of an associated lapping machine.

When the handle 38 is turned so that pointer 88 is disposed against stop 86 (see FIG. 2), spool 18 will be disposed as shown in FIG. 5 where all of the abrasive slurry received at inlet 42 is conducted through spool passages 82 and 80 to outlet 44 from which the slurry is recirculated to the pump for further use. In the latter position of spool 18, none of the abrasive slurry is supplied to the lapping wheel.

FIG. 4 illustrates an intermediate position of spool 18 where abrasive slurry supplied from the pump at inlet 42 is supplied to the spool at passages 82 and 80 from which a portion of the slurry is conducted downwardly to passage 78 and from there to the lapping wheel, and a remaining portion of the abrasive slurry is conducted out horizontal passage 44 from which the slurry is recirculated to the pump. It will be understood from the foregoing that through control of handle 38, an operator can supply to the lapping wheel of an associated lapping machine any desired portion of the total amount of abrasive slurry received at inlet 42, and the remaining amount of slurry will be recirculated to the pump.

Reference is now made to FIGS. 3 and 6 which illustrate the structure of 4-way splitter member 46. The purpose of 4-way splitter 46 is to conduct equal one-fourth portions of the abrasive slurry received from vertical passage 78 to the four passages 60, 62, 64 and 66 and into the four tubular members such as shown at 70, 72 and 74 which deliver the slurry to four selected areas on the lapping wheel of an associated lapping machine. Moreover, the purpose of splitter 46 is to achieve the foregoing without development of blockages in the passages or settling out of the abrasive particles from the slurry.

The upwardly directed divider arm 58 of splitter 46 extends up from the lower body portion 56 and has a pointed tip which extends slightly up into the lower end of supply passage 78 in valve body 12. The divider arm 58 has four sloping surfaces adjacent the upper tip, such surfaces being shown in FIG. 6 at **92*a*, 92*b*, 92*c* and 92*d*. Each of the foregoing surfaces 92*a*, 92*b*, 92*c* and 92*d* is dished out or concave, with the result that four "football-shaped" openings are provided between the upper end of divider arm 58 and the approximately abutting lower end of valve body portion 48 at the bottom of passage 78. FIG. 6 illustrates the four "football-shaped" openings 93***a*, 93*b*, 93*c* and 93*d* which are of equal area and are in communication respectively with the four tubular passages 60, 62, 64 and 66 leading to different locations on the associated lapping wheel.

It will be understood that the problems inherent in controlling flow of abrasive slurry and avoiding clogging of the slurry and settling out of the abrasive particles become more critcal when the volume of flow is reduced. Thus, the position of rotational spool 18 is set in accordance with the amount of abrasive slurry desired at the lapping wheel, which depends upon the type of lapping operation being performed, and when only a reduced amount of abrasive slurry is required at the lapping wheel, thereby reducing the flow of slurry into the lower portion of passage 78, the resultant pressure propelling the slurry tends to be reduced and the likelihood of clogging and settling out of the abrasive particles increases. Nevertheless, the directional spool 18 and 4-way splitter 46 of the valve assembly of the present invention have been found to perform well under all normal operating conditions.

Referring further to the 4-way splitter 46, it should be noted that the total area of the four "football-shaped" openings 93*a*, 93*b*, 93*c* and 93*d* is approximately equal to the total cross-sectional area of the vertical passage 78 which leads to such openings. Such a design has been found to provide an approximately equal supply of abrasive slurry to each of the four passages 60, 62, 64 and 66, and also to maintain approximately equal amounts of abrasive in the slurry supplied to each such passage.

It is believed an important advantage of the valve assembly of the present invention that the directional valve member or rotatable spool 18 and the 4-way splitter 46 are contained in the same assembly unit, and the 4-way splitter communicates with the rotational spool through a generally vertical passage 78. As a result, abrasive slurry to be conducted from valve inlet 42 to the lapping wheel of the associated lapping machine passes into valve body 12 at the upper end thereof at inlet 42 and then passes through the valve by moving downwardly through vertical passage 78 where at the lower end of the latter passage it enters the splitter member 46 and leaves through four inclined passages as shown at 68 in FIG. 3.

Accordingly, by providing a downward or gravity-assisted flow of abrasive slurry through the valve assembly, there is a reduced likelihood of clogging of the slurry within the valve. In particular, there is little possibility of clogging occurring between the directional valve or spool 18 and the splitter 46, since the slurry need only flow directly downwardly a short distance from the spool member to reach the splitter.

Another advantage of the valve assembly of the present invention is a reduction in the amount of abrasive slurry used. With previously known control valves, there was a tendency for slurry to clog in the valve and cause blockages. As a result, operators tended to open the valve more than would otherwise be necessary so as to increase the pressure and flow of slurry in an attempt to avoid blockages. Such a practice tends to waste abrasive slurry, which is normally not recirculated after being supplied to a lapping wheel. Because the valve assembly of the present invention is capable of minimizing clogging and blockages, even under reduced rates of flow of the abrasive slurry, it permits use of lower flow rates and thus conserves slurry.

What is claimed is:

1. A valve assembly for controlling the flow of abrasive slurry to the lapping wheel of a lapping machine or the like, said valve assembly comprising, in combination, a manually operable rotatable spool located adjacent an abrasive slurry valve inlet passage for controlling the amount of abrasive slurry to be conducted to said lapping wheel, a generally vertical passage leading downwardly from said rotatable spool for carrying abrasive slurry to be conducted to said lapping wheel, said spool being rotatable between a first limiting position where substantially all of the abrasive slurry received at said inlet passage is conducted down said generally vertical passage for delivery to said lapping wheel and a second limiting position where substantially all of the abrasive slurry received at said inlet passage is conducted to a return passage from which it is recirculated to a supply pump, and a 4-way splitter member positioned at the lower end of said generally vertical passage for dividing said abrasive slurry into four approximately equal amounts for delivery to four different areas on said lapping wheel, said splitter member including an upwardly directed divider arm having a tip which extends partly up into the lower end of said generally vertical passage, and four separate passages surrounding said tip and in communication with said generally vertical passage for receiving approximately equal amounts of abrasive slurry from said generally vertical passage for delivery to different locations on said lapping wheel.

2. A valve assembly as defined in claim 1 where said upwardly directed divider arm has four concave surfaces adjacent said tip which surfaces define four generally football-shaped openings by which the lower end of said generally vertical passage communicates with said four separate passages surrounding said tip.

3. A valve assembly as defined in claim 2 where the total cross-sectional area of said four football-shaped openings is approximately equal to the cross-sectional area of said generally vertical passage.

* * * * *